US008207904B2

(12) United States Patent
Pan et al.

(10) Patent No.: US 8,207,904 B2
(45) Date of Patent: Jun. 26, 2012

(54) HIGH GAIN MULTIPLE PLANAR REFLECTOR ULTRA-WIDE BAND (UWB) ANTENNA STRUCTURE

(75) Inventors: Bo Pan, Irvine, CA (US); Frederic Battaglia, Irvine, CA (US); KuangYu Li, Irvine, CA (US); Ran-Hong Yan, Irvine, CA (US); Kuan Leok Sun, Irvine, CA (US)

(73) Assignee: Realtek Semiconductor Corp., Hsinchu (TW)

( * ) Notice: Subject to any disclaimer, the term of this patent is extended or adjusted under 35 U.S.C. 154(b) by 404 days.

(21) Appl. No.: 12/488,509

(22) Filed: Jun. 19, 2009

(65) Prior Publication Data

US 2010/0321270 A1 Dec. 23, 2010

(51) Int. Cl.
*H01Q 9/28* (2006.01)

(52) U.S. Cl. ..... 343/795; 343/818

(58) Field of Classification Search ..... 343/795, 343/818, 819, 821

See application file for complete search history.

(56) References Cited

U.S. PATENT DOCUMENTS

| | | | | |
|---|---|---|---|---|
| 5,061,944 | A * | 10/1991 | Powers et al. | 343/795 |
| 7,064,728 | B1 | 6/2006 | Lin et al. | |
| 2003/0160730 | A1* | 8/2003 | Alsliety | 343/818 |
| 2003/0231138 | A1* | 12/2003 | Weinstein | 343/795 |

* cited by examiner

*Primary Examiner* — Hoanganh Le

(74) *Attorney, Agent, or Firm* — Thomas, Kayden, Horstemeyer & Risley, LLP

(57) ABSTRACT

Multiple out-of-plane planar reflectors can be used to build a receive/transmit high-gain directional antenna. The driver portion and the first reflector of the antenna are formed within a metal layer of a PWB. A plurality of sets of reflector plates can be placed on the PWB, on a non-conductive low-dielectric constant material coating both opposing planar surfaces of the PWB, or on the opposing sidewalls of the product housing unit. The metal layer in the PWB is placed between the reflector plates. The plates can have either a parallel or non-parallel orientation to each another. This greatly increase the received power and thus increases the operating range of a low-power UWB system, as well as significantly improves wireless data transmission throughput. This antenna is applicable for USB communications systems.

16 Claims, 12 Drawing Sheets

HIGH GAIN MULTIPLE PLANAR REFLECTOR ULTRA-WIDE BAND (UWB) ANTENNA STRUCTURE

BACKGROUND OF THE INVENTION

Antennas are one of the components in a wireless system infrastructure that are used to transfer information between two different points in space. The antenna is a transducer that transforms currents and voltages in circuits into electric and magnetic fields in free space and vice-versa. These electric and magnetic fields propagate in free space; in addition, these fields can be modulated to carry information. Wireless signals carry information that is launched/captured into/from free space by an antenna.

Some examples of UWB (Ultra-Wideband) antennas that are used in the field include a dipole whip or rod, a printed PCB (Printed Circuit Board) wide dipole/monopole, or a ceramic omni-directional UWB antenna. Several different examples are provided. FIGS. 1*a* through 1*c* illustrate different examples of printed PCB dipole UWB antennas using different shapes for the dipole portion of the antenna. Typically, a solid metallic plane or surface is perpendicular to the axis of the main radiation beam. In FIG. 1*a*, a dipole 1-1*a* uses ovals 1-2*a* and 1-3*a* for the dipole elements. The dipole is a center fed driven structure as indicated by 1-4*a* where the structure is balanced and consists of the two conducting coplanar ovals 1-2*a* and 1-3*a*. The transceiver (not shown) would be connected to the center 1-4*a* of the antenna (in addition, a switch, an integrated transceiver IC, and/or a tuning network may be inserted between these components).

An example using rectangular elements for the UWB dipole 1-1*b* is illustrated in FIG. 1*b*. The center feed 1-4*b* is connected to the rectangular dipoles 1-2*b* and 1-3*b*. Triangular elements 1-2*c* and 1-3*c* are the dipole elements which are fed by the feed point 1-4*c* as indicated in FIG. 1*c*. Several different polygon shapes were illustrated in FIG. 1*a* through 1*c* indicating that the dipole elements can have various polygon shapes. However, the final dipole element needs to be optimized in shape and size for proper UWB operation.

Another antenna type can include a planar reflector (usually formed from an antenna ground) can be designed to form quasi-Yagi antenna structures in PCBs. An example is illustrated in FIG. 2*a* which depicts a double sided PWB. The metallization on the top side is the solid color while the cross-hatched pattern is the metallization on the bottom side of the PWB.

Although not indicated, the PWB could be a multi-layer board. The additional layers can be patterned into reflector plates to form multiple reflectors for the Multiple Planar Reflector Ultra-Wide Band (UWB) Antenna.

FIG. 2*a* shows a patterned layout that is used to form a quasi-Yagi antenna 2-1. A PWB 2-2 has a dipole 2-3 and a director 2-4 that is formed on the same top side of the board. The cross-hatch area is the ground plane reflector 2-5 formed on the bottom side of the board. The feed point 2-6 identifies where the transceiver would be connected.

FIG. 2*b* shows a patterned layout that is used to form a different quasi-Yagi antenna 2-7. A PWB 2-2 has a dipole 2-3 but in this case the director is eliminated. A ground plane formed on the bottom side below the Yagi feedpoint 2-6 that is cross-hatched becomes part of the reflector 2-5. The feed point 2-6 identifies where the transceiver would be connected.

FIG. 2*c* illustrates a dipole antenna 2-8 on a PWB 2-11. The two metallic rectangular sections 2-9 and 2-10 form the dipole elements.

In FIG. 2*d*, the structure 2-12 as indicated in Lin et al., U.S. Pat. No. 7,064,728, is an ultra-wideband dipole antenna 2 in accordance with a first preferred embodiment of the invention comprising a generally axially disposed first outer metal sleeve 20 having a closed face 201 at a top end thereof opposite its open bottom end, and a hole 202 through the closed face 201; a generally axially disposed intermediate metal sleeve 22 dimensioned to be surrounded by the first outer metal sleeve 20, the intermediate metal sleeve 22 having a closed face 221 at a top end thereof opposite its open bottom end, and a hole 222 through the closed face 221; a generally axially disposed second outer metal sleeve 23 above the first outer metal sleeve 20, the second outer metal sleeve 23 having a closed face 231 at a bottom end thereof opposite its open top end; a conductive interconnection 24 having a bottom end 241 extended through the hole 202, a feed point location 243 at the bottom end 241, and a top end 242 electrically connected to the closed face 231; and an inner coaxial conductor 25 surrounded by the intermediate metal sleeve 22, the coaxial conductor 25 including a central conductor 251 electrically connected to the feed point location 243 and an outer grounding sleeve 252 surrounding the central conductor 251 and electrically connected to edges of the hole 222.

In addition, there is the three-dimensional parabolic reflector antenna. The parabolic surface focuses the reflected incoming energy into a focal point or emits outgoing energy from the focal point to the parabolic surface forming a narrow beam emitted from the antenna. The transceiver is positioned at the focal point to receive or transmit a desired signal. The parabolic antenna is bulky, heavy and costly.

A desirable feature would be to increase the directivity of an antenna without necessarily increasing the cost or weight of the system. A need of building a high-gain directional antenna for the receive and transmit paths of a transceiver is highly desirable. This greatly increases the received/transmitted powers and thus increases the operating range of a low-power wireless system. Another benefit is that the wireless data transmission rate can be improved providing higher signal bandwidths.

BRIEF SUMMARY OF THE INVENTION

This invention relates to the idea of using multiple planar reflectors to build a high-gain directional antenna for the receive/transmit paths to improve the quality of the wireless link. It is important to note that designing a high-gain directional antenna to receive a particularly weak signal, also implies that the antenna will transmit a stronger signal in the high gain direction in the same given frequency range of operation. The maximum EIRP (effective isotropically radiated power) also known as maximum transmitted power is specified by FCC (Federal Communications Commission). The EIRP sets the upper limit of the power radiated in any spatial direction from a UWB system. The maximum UWB power levels allowed by the FCC provide marginal received power levels during the reception of video over short distances. With this transmit EIRP limit, a high-gain antenna is not required for the transmit chain since the power level coupled into the antenna has to be reduced to get the same amount of power radiated into space. The effective power spatial density remains the same. However, it would be desirable to increase the gain of antenna to increase the power of the received signals. On the receive chain, for the same spatial power density presented to the antenna, a high gain antenna couples more power into the receiver IC. Designing a high gain omni-directional antenna is possible but will be very challenging. Meanwhile, for many application scenarios, an omni-directional transmit/receive antenna is not necessary. The other method to get a high gain antenna is to asymmetrically distribute the radiation patterns. An asymmetrically antenna would increase the received power levels for certain directions. Thus, the receiver at these points can receive higher power levels and improve the bit error rate of the USB wireless link.

The design of the asymmetrical antenna is achieved by altering the physical attributes of the system. Some of the physical attributes can be implemented in the PWB, in the regions surrounding the PWB and on the sidewalls of the housing unit. The modification of the physical attributes can be done at very low cost. When the transmit/receive paths shares the same physical antenna, the transmit power would need to be backed off to accommodate a high gain antenna for EIRP limit set by FCC. This brings additional advantage in that a potential transmit power reduction may be possible using the high gain antenna. This greatly increases the operating range of a low-power wireless system, significantly improves the wireless data transmission throughput, and saves power at the transmitter.

An embodiment of the high-gain directional antenna uses a driver plate located within a PWB and at least two reflector plates located on either side of the first plate in the PWB. All three plates are non-intersecting. The reflector plates can be considered to be out-of-plane with the first plane forming the multiple planar reflector antenna structure. The reflector plates can be parallel or non-parallel to the first plate. These reflector plates can be mounted to the sidewalls of the unit and be parallel to each other, can be attached to a foam containing non-conductive low-dielectric constant material that is deposited on the sidewalls, can be positioned on foam to have a wedge shape or be parallel to one another. In some cases, the non-parallel sidewalls can offer an improved performance for this inventive technique. Several embodiments of antennas using several multiple planar reflector plates embodying this inventive aspect to form high-gain directional antennas will be provided.

In another aspect of the invention provides a method of improving the gain of an antenna by using multiple planar reflectors comprising the steps of: pattering a metallic driver plate in a metal layer of a PWB; pattering a first reflector plate in the metal layer of the PWB; isolating the driver plate from the first reflector plate; positioning at least one set of reflector plates where the set comprises an upper reflector plate placed above the metallic driver plate, and a lower reflector plate placed below the metallic driver plate; wherein the driver and all reflector plates can assume any polygon shape, and all plates are isolated from one another.

In another aspect of the invention provides a method that further comprises depositing a layer of non-conductive low-dielectric constant material on the top and bottom planar surfaces of the PWB; whereby the upper and lower reflector plates are placed on the opposing planar surfaces of the material.

In another aspect of the invention provides a method that further comprises supporting the PWB within a product housing unit; attaching the upper and lower reflector plates to the opposing sidewalls; and positioning the PWB between the upper and lower reflector plates.

In another aspect of the invention provides a method that further comprises staggering the placement of the sets of reflector plates along a main beam direction or offsetting the placement of the sets of reflector plates from the main beam direction to improve the gain of an antenna by using multiple planar reflectors.

In another aspect of the invention provides a method adjusting a parameter of a multi planar antenna comprising the steps of: patterning a driver plate in a first metal layer of a PWB; patterning a first reflecting plate in another portion of the first metal layer of the PWB; a means for forming a plurality of sets of reflector plates; and a means for positioning these sets of reflector plates with respect to a main beam direction to adjust a parameter of the antenna.

In another aspect of the invention provides a method that further comprises staggering the sets of reflector plates along the main beam direction; or offsetting the sets of reflector plates from the main beam direction; thereby adjusting the parameter of gain, the beam direction or the angular coverage.

In another aspect of the invention describes a multi planar antenna apparatus that comprising: a metallic driver plate patterned in a metal layer of a PWB; a first reflector plate patterned in the metal layer of the PWB and isolated from the driver plate; at least one set of reflector plates comprising: an upper reflector plate placed above the metallic driver plate; and a lower reflector plate placed below the metallic driver plate; wherein the driver and all reflector plates can assume any polygon shape, and all plates are isolated from one another.

In another aspect of the invention describes a multi planar antenna apparatus that further comprises a non-conductive low-dielectric constant material deposited on both opposing planar surfaces of the PWB; whereby the upper and lower reflector plates are placed on the opposing planar surfaces of the material.

In another aspect of the invention describes a multi planar antenna apparatus that further comprises a product housing unit supporting the PWB; the PWB is placed between opposing sidewalls of the product housing unit; whereby the upper and lower reflector plates are attached to the opposing sidewalls.

The design criteria for the antenna can be segregated from the design criteria of the transceiver. This provides a flexibility of selecting the most cost effective $3^{rd}$ party design for the transceiver since the transceiver can be a plug and play unit. Of course, the transceiver can be formed using discrete components on a PCB, packaged in an integrated circuit chip that was fabricated in a high tech facility and connected to the PCB, or any other combination of packaging and mounting techniques that can be used to build the components of a wireless system infrastructure known in the art.

All reflector and driver plates are shaped as polygons. A polygon is a shape defined as a plane figure that is bounded by a closed line path. Thus a triangle, a square, a rectangle or an octagon can be considered a polygon. In some case, one or more sides of the polygon may be substituted with a curved line, in any case, this shape with at least one curved line will still be called a polygon. The polygons can have a finite thickness. For example, polygons stamped out of metal plates would have the thickness of the metal plate.

A set of reflector plates is formed when a first and a second reflector plate are either symmetrically or asymmetrically placed about a center plane forming a set of out-of-plane reflector plates or simply a set of reflector plates. This invention proposes to use several discrete metal surfaces that are placed in a given relationship with respect to the axis of main radiation beam to improve the gain of the antenna. Compared with a three dimension scheme for traditional reflector-based antennas, this invention reduces manufacturing/assembly complexity and cost significantly, while demonstrating similar antenna gain by optimizing the shapes, dimensions, and positions of these discrete partial reflectors that are claimed in this invention.

BRIEF DESCRIPTION OF THE DRAWINGS

Please note that the drawings shown in this specification may not be drawn to scale and the relative dimensions of various elements in the diagrams are depicted schematically and not to scale.

DETAILED DESCRIPTION OF THE INVENTION

Figure 1:
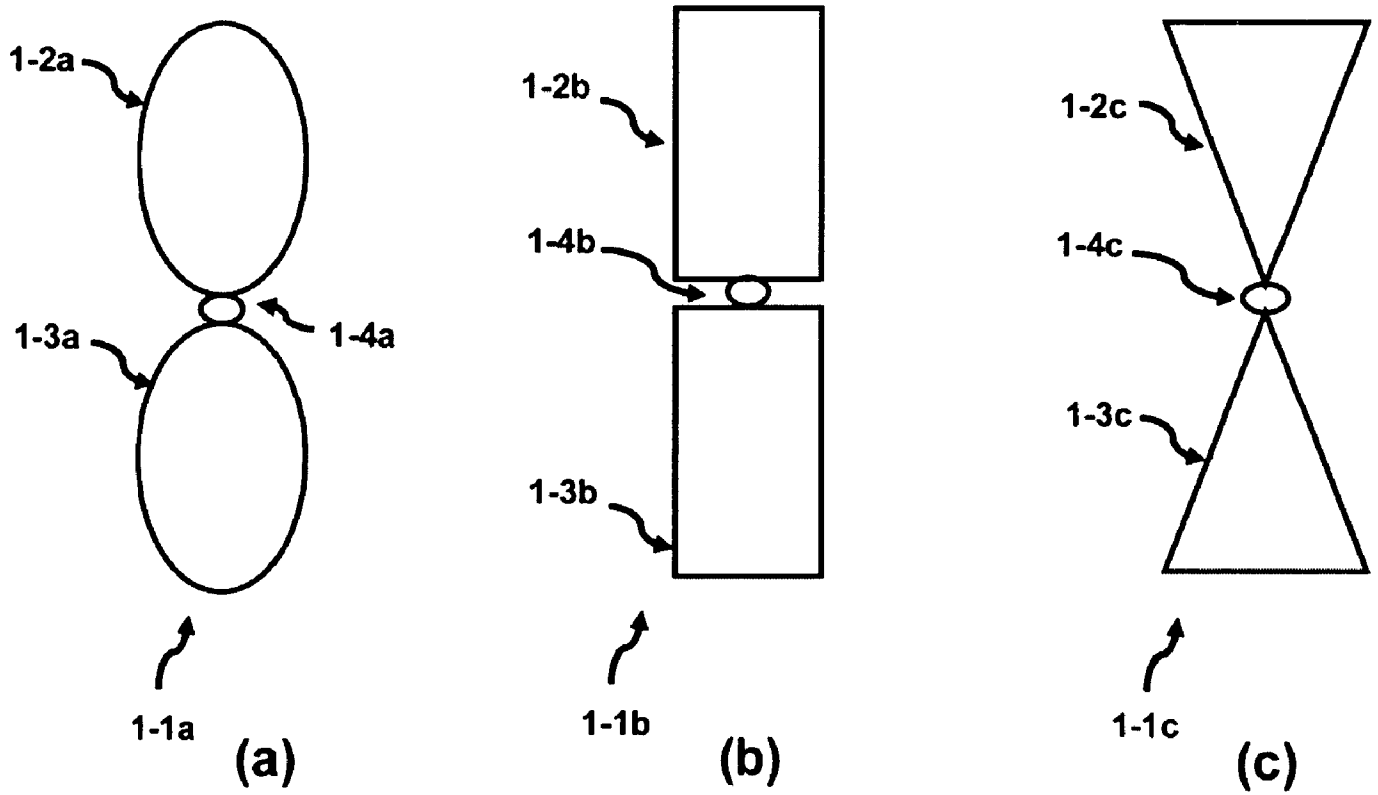
FIG. 1 (prior art)
FIG. 1*a* shows an oval UWB dipole antenna.
FIG. 1*b* shows a rectangular UWB dipole antenna.
FIG. 1*c* shows a triangular UWB dipole antenna.
Figure 2A:
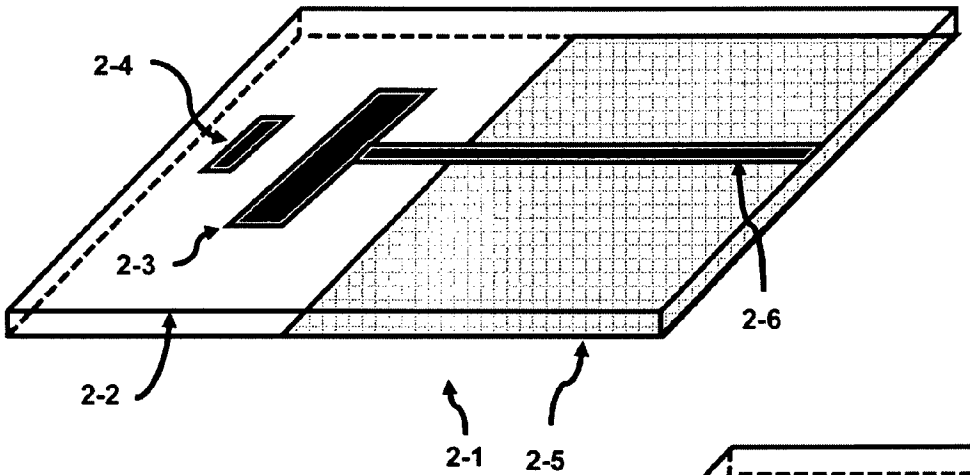
FIG. 2a (prior art)
FIG. 2*a* illustrates a PWB artwork illustrating the various components of a quasi-Yagi antenna using a director.
Figure 2B:
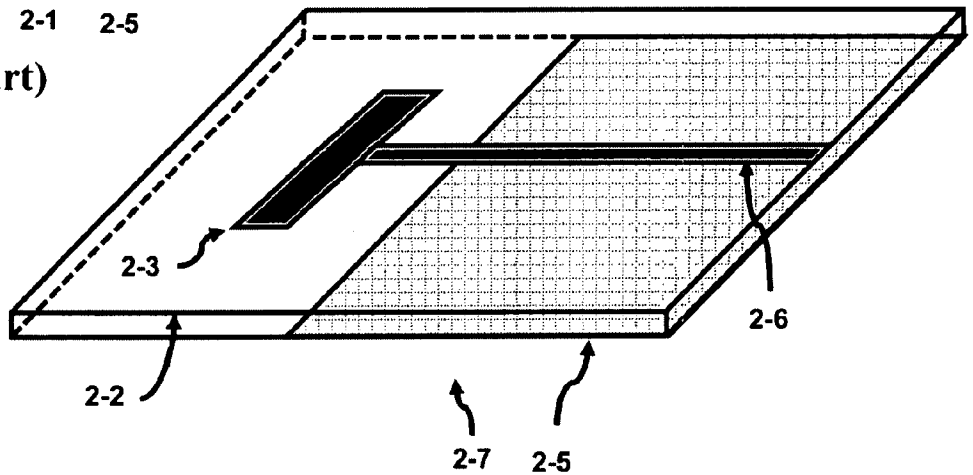
FIG. 2b (prior art)
FIG. 2*b* illustrates a PWB artwork illustrating the various components of a quasi-Yagi antenna without a director.
Figure 2D:
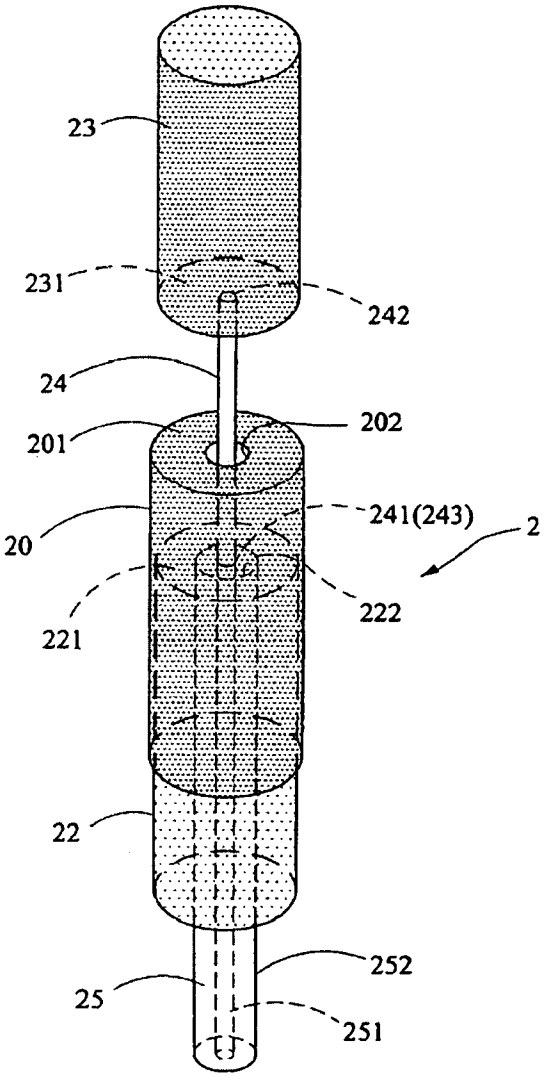
FIG. 2d (prior art)
FIG. 2*d* illustrates a 3D artwork illustrating the ultra-wide-band antenna.
Figure 2C:
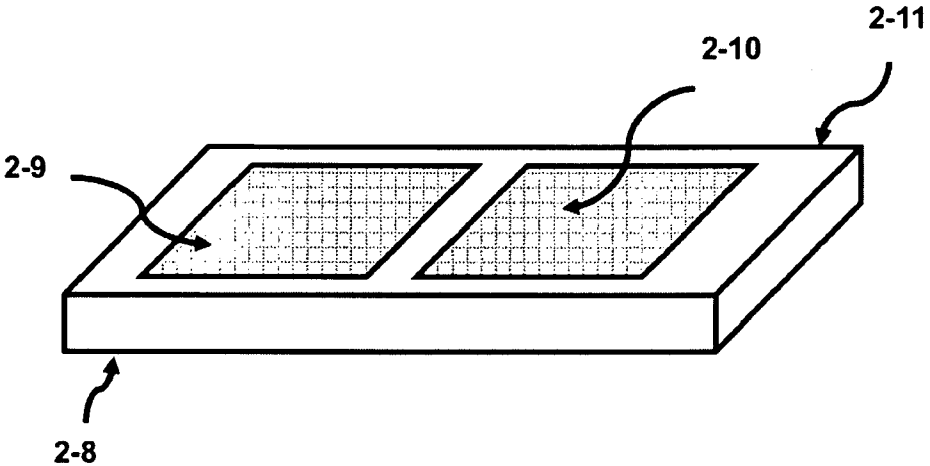
FIG. 2c (prior art)
FIG. 2*c* illustrates a PWB artwork illustrating the various components of a UWB dipole antenna.
Figures 3A, 3B, 3C:
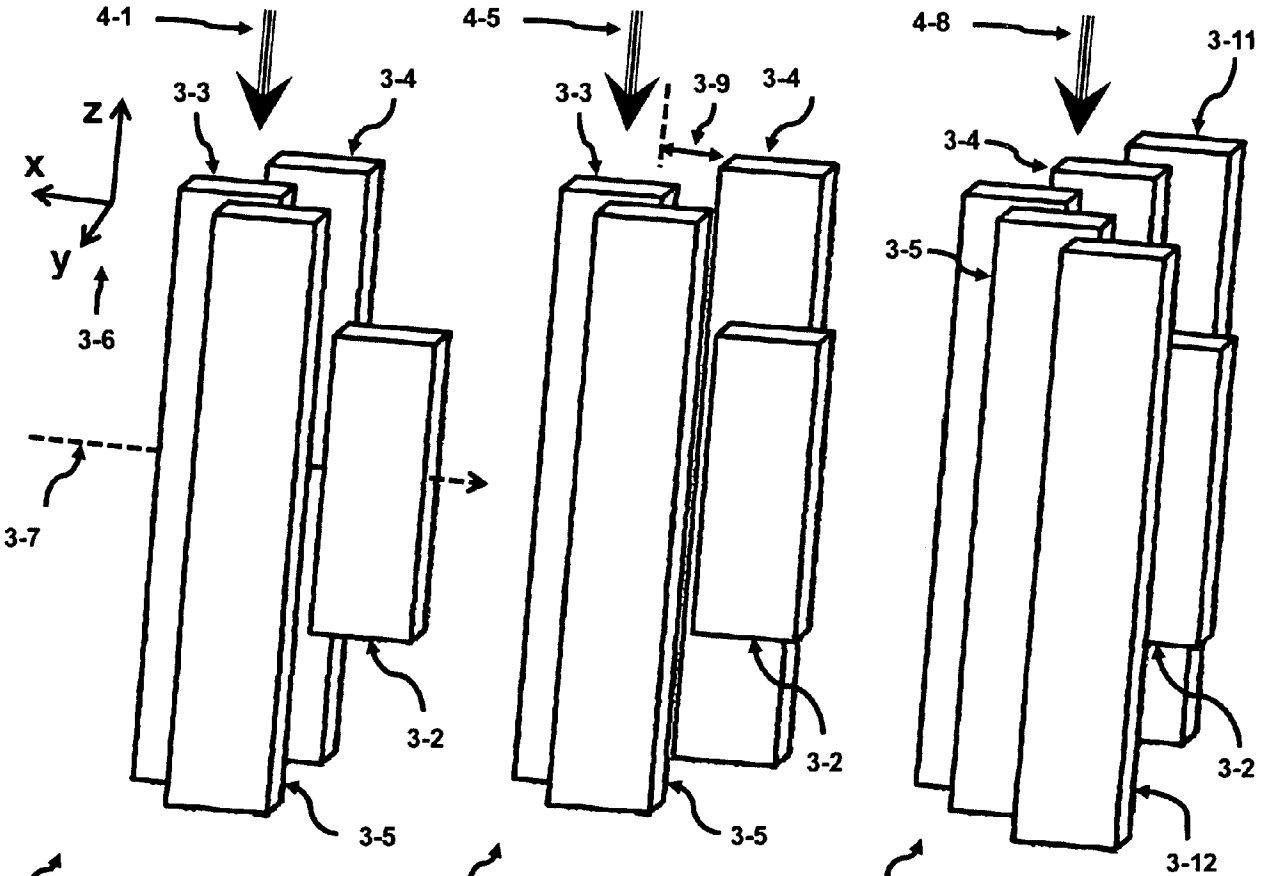
FIG. 3*a* depicts a cross-view 3-D perspective of a high gain multiple planar reflector antenna structure in accordance with the present invention.
FIG. 3*b* depicts a cross-view 3-D perspective of a high gain asymmetrical multiple planar reflector antenna structure in accordance with the present invention.
FIG. 3*c* depicts a cross-view 3-D perspective of a high gain multiple planar reflector antenna structure with two sets of reflector plates in accordance with the present invention.

FIG. 3*a* illustrates a side perspective for one embodiment of an antenna 3-1 that uses reflectors both in and out-of-plane. A Cartesian coordinate axis 3-6 is provided. The transceiver (not shown) would be coupled to a driver plate 3-2. The remaining in-plane element is a reflector plate 3-3. These two elements are in the xz plane with y=0. In addition, the main beam direction 3-7 is depicted and indicated the direction of increased power intensity. A first out-of-plane reflector plate 3-4 is located in the negative y region or below the xz plane. The second out-of-plane reflector plate 3-5 is located in the positive y region or above the xz plane. The in-plane reflector plate 3-3 and the driver plate 3-2 are isolated from each other; that is, the electrical impedance between these two conductor plates are Mega Ω's or higher. This isolation can occur when the metal layer used to form the reflector and driver plates is partitioned into at least two separate metallic segments isolated by the dielectric forming the PWB. The view from the top 4-1 will be shown in FIG. 4*a*.

FIG. 3*b* depicts a side perspective for another embodiment of an antenna 3-8 that uses reflectors both in and out-of-plane. A first out-of-plane reflector plate 34 is located in the negative y region or below the xz plane. The second out-of-plane reflector plate 3-5 is located in the positive y region or above the xz plane. This structure is almost identical to the structure in FIG. 3*a* except that the reflector plate 3-4 is asymmetrically placed when compared to the reflector plate 3-5. The plate 3-4 is shifted a distance 3-9 in the main beam direction. This tends to steer the beam out of the PWB plane. The view from the top 4-5 will be shown in FIG. 4*b*.

FIG. 3*c* shows a side perspective for one embodiment of an antenna 3-10 that uses two sets of reflectors. The first set of reflector plates 3-5 and 3-4 are in the same position as in FIG. 3*a*. The second set of reflector plates 3-11 and 3-12 are added to the structure of FIG. 3*a*. The view from the top 4-8 will be shown in FIG. 4*c*.

Figure 4B:
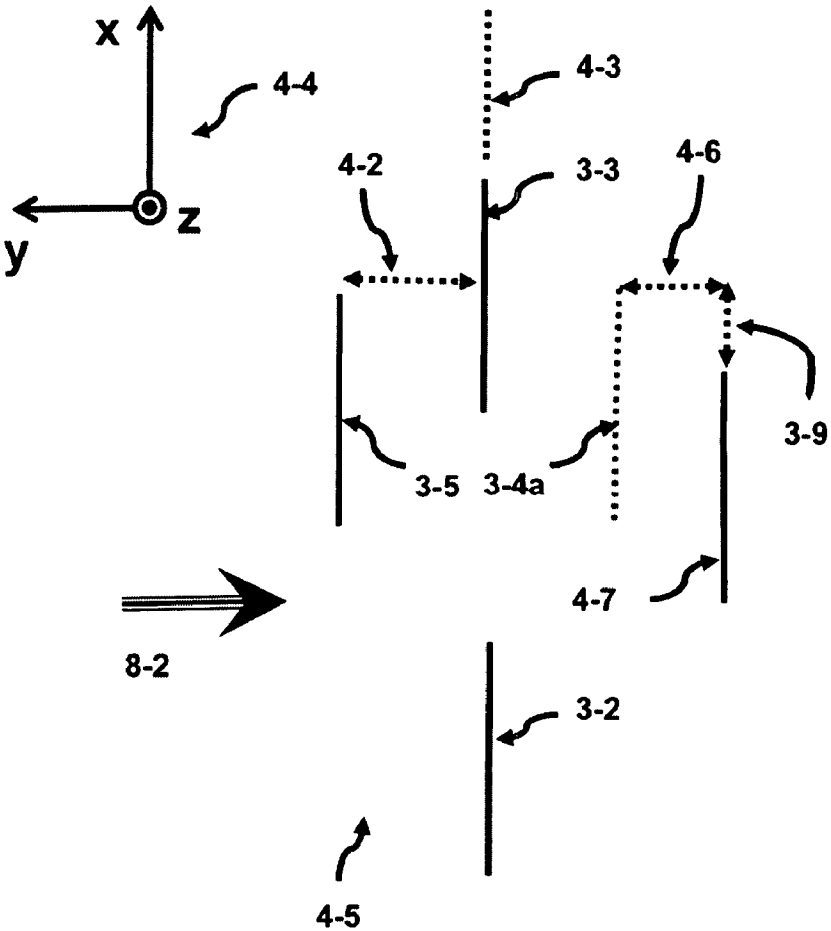
FIG. 4*b* presents a top view perspective of FIG. 3*b* of the high gain asymmetrical multiple planar reflector antenna structure in accordance with the present invention.
Figure 4A:
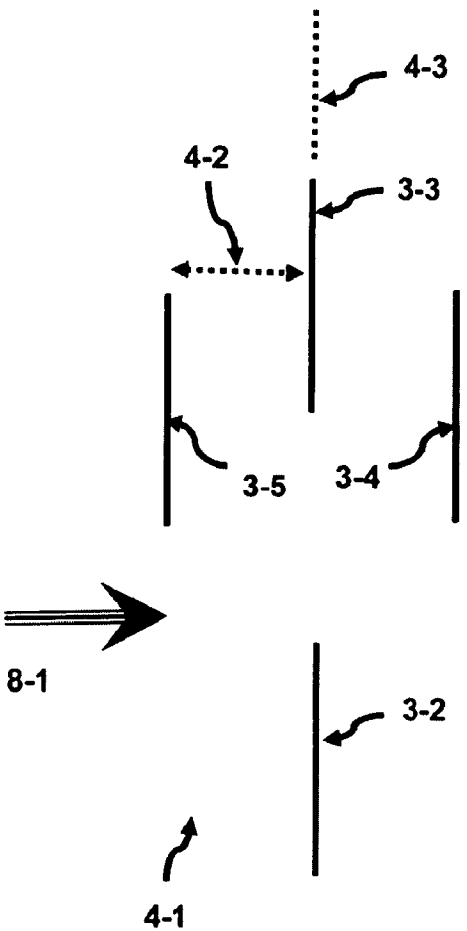
FIG. 4*a* presents a top view perspective of FIG. 3*a* of the high gain multiple planar reflector antenna structure in accordance with the present invention.

FIG. 4*a* presents the top view perspective 4-1 of FIG. 3*a*. The Cartesian coordinate axis 3-6 that was provided in FIG. 3*a* is re-orientated for this perspective view and illustrated in 4-4. The dotted line 4-3 presents the edge wise view of the in-plane 4-3 that contains the driver plate 3-2. The reflector plate 3-3 is also in the in-plane 4-3. Referring to coordinate 4-4, the driver and reflector plates are in the xz plane where y=0. The reflector plates 3-5 and 3-4 are the out-of-plane reflectors, for example, both plates 3-5 and 3-4 are a distance 4-2 from the in-plane 4-3. The out-of-plane reflector plates can come in sets. For example, 3-5 and 3-4 comprise a first set; that is, the position of the second out-of-plane reflector plate 3-5 can be determined by mirror imaging the first out-of-plane reflector plate 3-4 about the plane 4-3 that contains the in-plane reflector plate 3-3 and the driver plate 3-2. Superimposing the second out-of-plane 3-5 over this image forms the set of out-of-plane reflector plates 3-5 and 3-4. In other words, the upper and lower reflector plates are symmetrically located about the first reflector plate forming a first set of out-of-plane reflector plates. The set of out-of-plane reflector plates will also be referred to as a set of reflector plates. A side view 8-1 will be shown in FIG. 8*a*.

FIG. 4*b* illustrates the top view perspective 4-5 of FIG. 3*b*. The structure in FIG. 4*b* is similar to the structure in FIG. 4*a* except that the reflector plate 3-4 which should be in the dotted line position identified by 3-4*a* is instead re-positioned as 4-7. In other words, the reflector plate 4-7 is displaced from the symmetrical position at 3-4*a*. The total displacement distance is composed of the Manhattan distances of 4-6 and 3-9. The distance 3-9 was illustrated earlier in FIG. 3*b*. The two plates 3-5 and 4-7 now have an asymmetrical structure. This type of structure can be used to steer the beam out of the PWB plane. A side view 8-2 will be shown in FIG. 8*b*.

Sometimes it is not possible to get equal separation between the two out-of-plane reflector plates and the driver plate. Asymmetric reflector placement offers the ability to compensate for the lack of equal separation. Asymmetry reflector placement can be used to steer the beam away or toward the plane containing the driver plate (the in-plane). Thus, asymmetry reflector placement has two uses: 1) to steer the beam away from the in-plane intentionally when there is equal separation; and 2) steer beam back to the in-plane when equal separation is not possible due to a mechanical limitation. Asymmetric reflector placement is one tool that offers flexibility in beam steering.

Figure 4C:
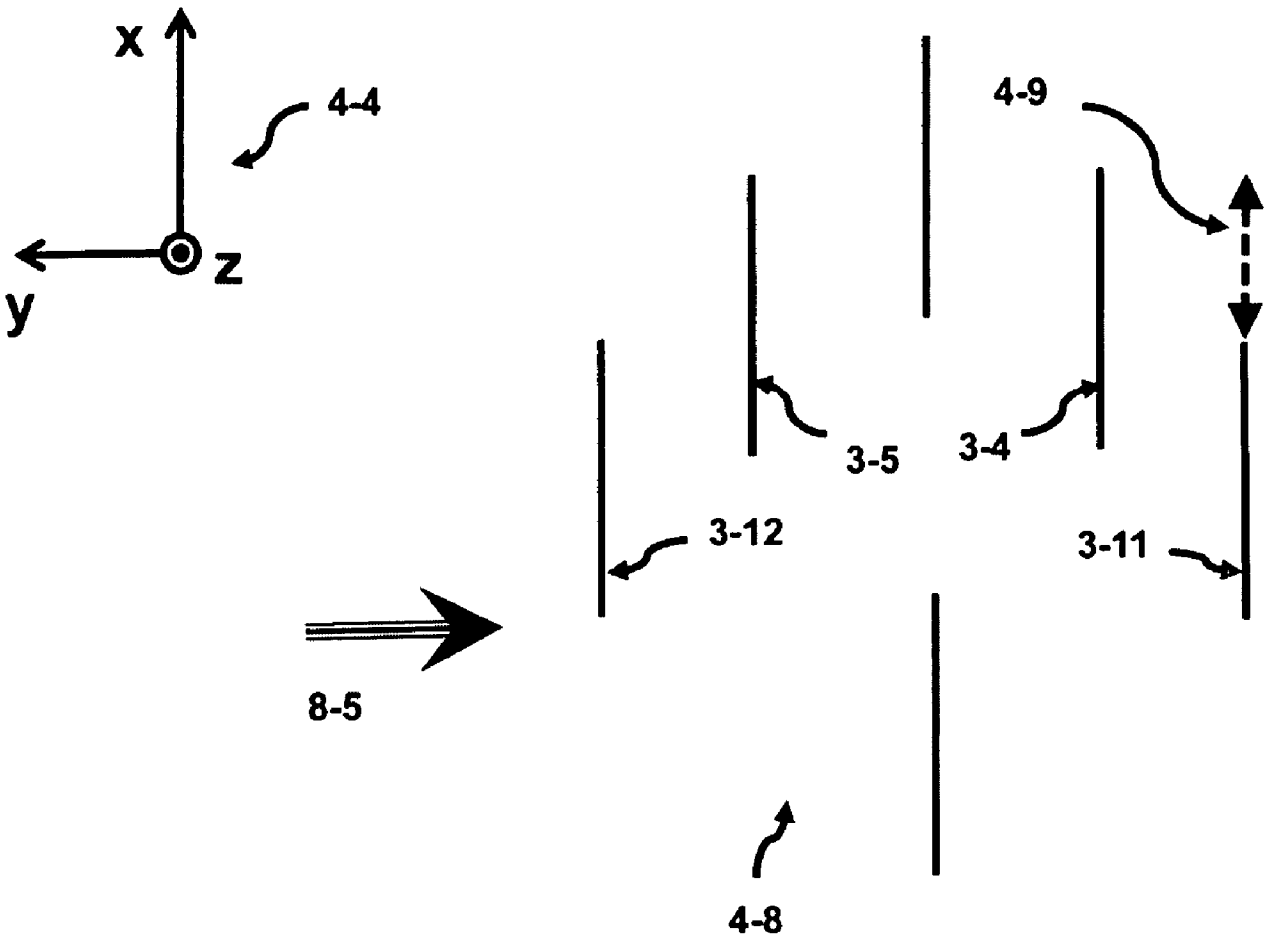
FIG. 4*c* depicts the top view perspective of FIG. 3*c* where another set of reflector plates are added to the high gain multiple planar reflector antenna structure in accordance with the present invention.

FIG. 4*c* illustrates the top view perspective 4-8 of FIG. 3*c*. FIG. 4*c* illustrates the situation where an additional set of reflector plates 3-12 and 3-11 have been added to the previous configuration that was shown in FIG. 4*a*. The positioning of the additional set is staggered 4-9 from the position of the first set. In addition, the positioning of the additional set can be offset from the position of the first set. The offset is the displacement difference measured in a direction (not shown) that is perpendicular to the staggered 4-9 direction. A side view 8-5 will be shown in FIG. 8*c*

Figure 5B:
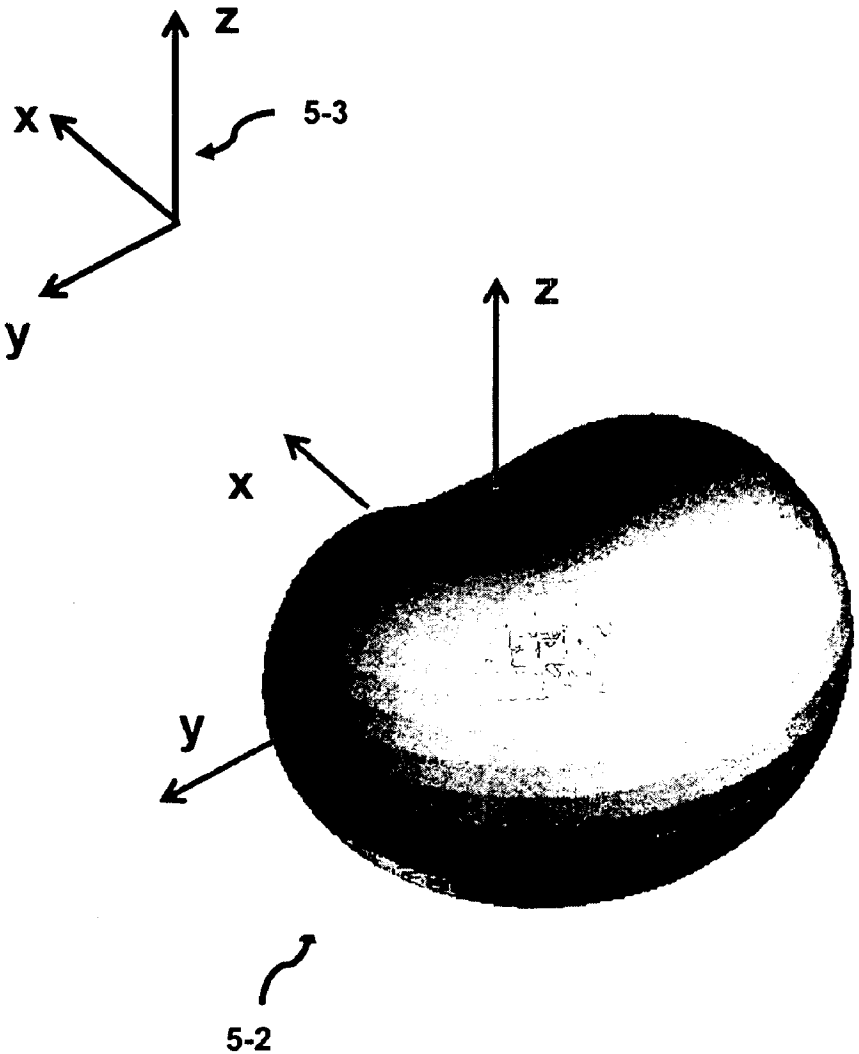
FIG. 5*b* illustrates the radiation patterns of the high gain multiple planar reflector UWB antenna structure in accordance with the present invention.
Figure 5A:
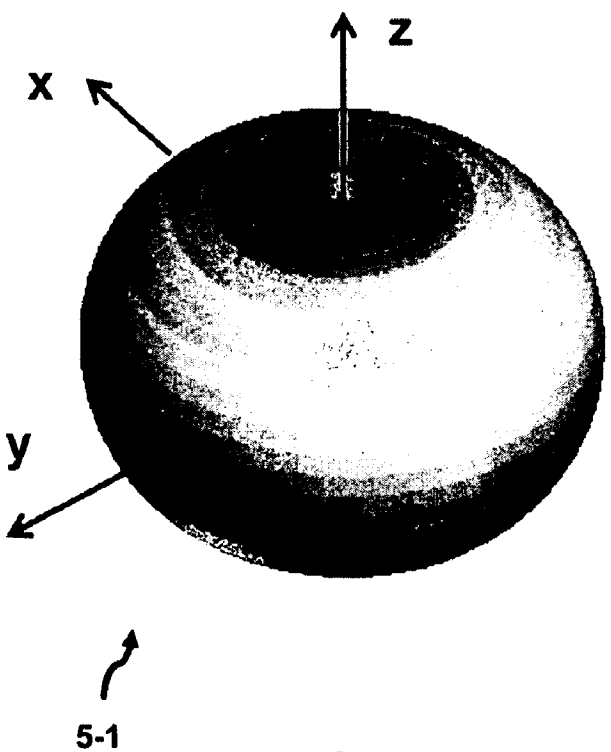
FIG. 5*a* shows an omni-directional radiation pattern for a traditional UWB antenna.

FIG. 5*a* shows the radiation pattern 5-1 of a traditional omni-directional pattern for a UWB antenna. The Cartesian coordinate axis 3-6 that was provided in FIG. 3*a* is re-orientated for this perspective view and illustrated in 5-3. FIG. 5*b* illustrates the radiation pattern 5-2 simulated when using the inventive structure that improves the gain of the UWB antenna. There is a higher gain in the negative x-direction. Note that the orientation of the physical antenna as given in FIG. 3*a* also depicts the main beam direction 3-7. The increased gain in FIG. 5*b* is in the direction of the main beam along the negative x-direction.

Figure 6B:
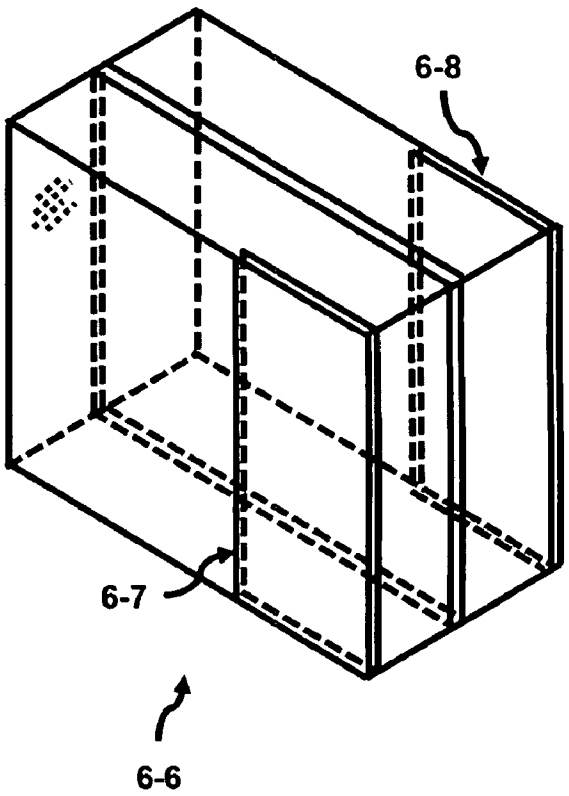
FIG. 6*b* illustrates the addition of the out-of-plane reflector plates to the inside sidewalls of the product housing unit in accordance with the present invention.
Figure 6A:
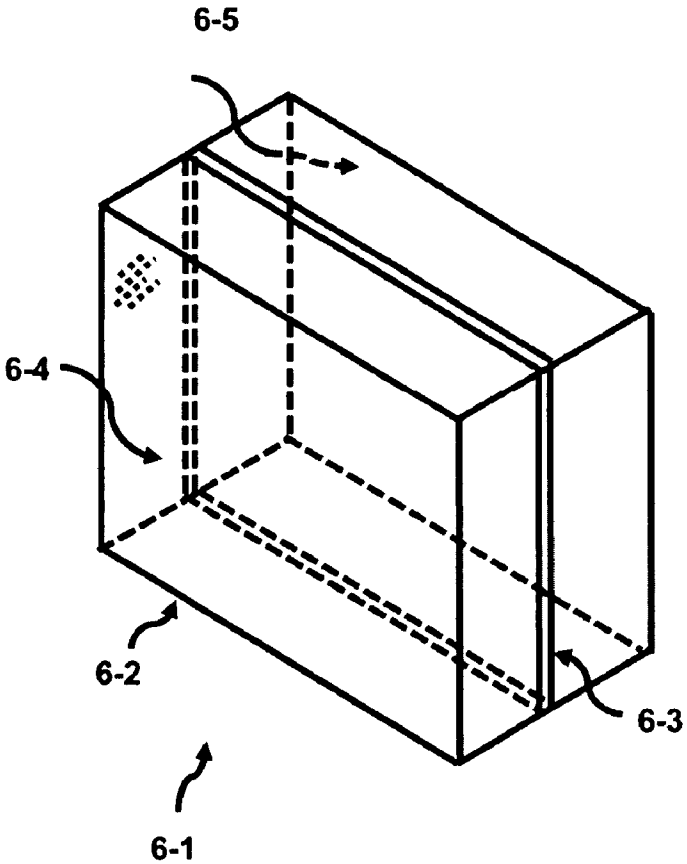
FIG. 6*a* shows a product housing unit that supports and contains the PWB.

FIG. 6*a* depicts an outside view 6-1 of the product housing unit 6-2. The housing unit has six sides where the sides 6-4 and 6-5 are opposing sidewalls. The PWB 6-3 is placed approximately between the two opposing sidewalls 6-4 and 6-5 where the PWB and the two opposing sidewalls in this case are parallel to one another as shown in FIG. 6*a*. However, the housing unit could also be constructed with a trapezoidal or wedge shape such that the sidewalls are not parallel to one another but lie on the edges of a sliced pie wedge. Secondly, the sidewalls can also include any internal walls placed inside the housing unit. The context of the meaning of sidewalls is extended to include the above definitions. The PWB 6-3 is mounted inside of the unit 6-2. The PCB board ground (not shown) is located inside the PWB 6-3 and can be used as the center partial reflector.

FIG. 6*b* illustrates an embodiment where the antenna structure 6-6 uses the PCB board ground as the center partial reflector and a set of two metal plates 6-7 and 6-8 as additional reflector plates that are attached to the inside of the sidewalls of the product housing as depicted in FIG. 6*b*. The plates can be attached to the sidewalls by using an adhesive, a foam or a indentation formed in the sidewall to mate and surely hold the plate to the sidewall. The copper plates can be parallel to the ground plane of the PWB as shown, or can be formed to have a wedged shape structure by appropriate positioning the plates on the foam prior to curing.

Figure 7A:
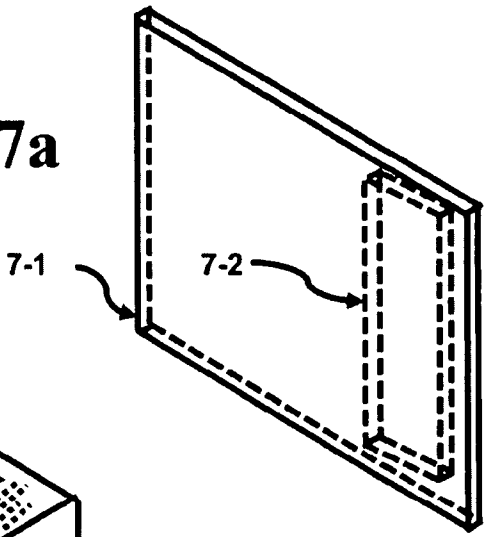
FIG. 7*a* depicts a PWB.
Figure 7B:
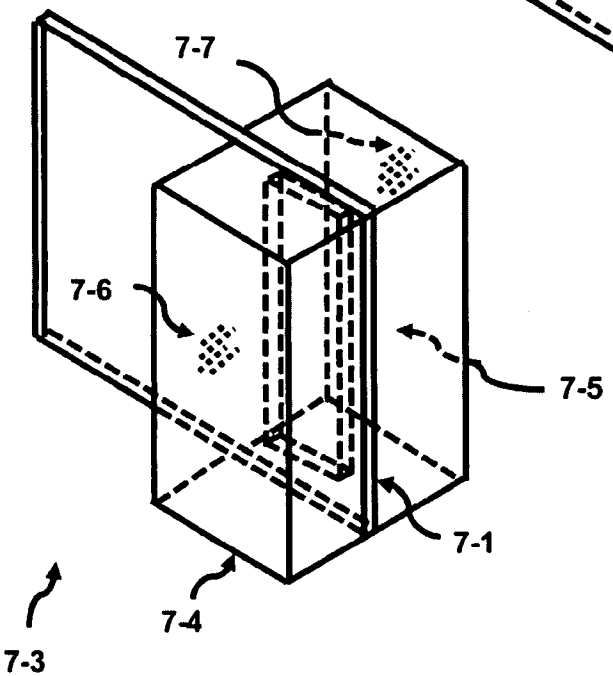
FIG. 7*b* depicts a PWB with a portion of the front and back surfaces covered with a foam that cures into a non-conductive low-dielectric constant material.
Figure 7C:
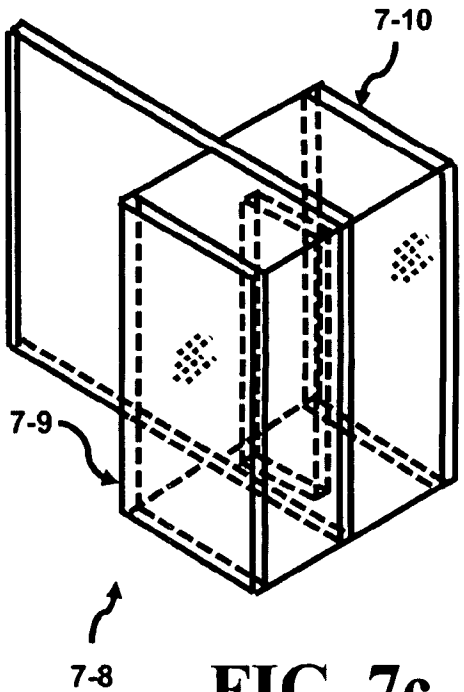
FIG. 7*c* illustrates the addition of the out-of-plane reflector plates to the foam in accordance with the present invention.

FIG. 7*a* depicts a PWB 7-1. A ground plane 7-2 is illustrated in FIG. 7*a*. Foams that contain other non-conductive low-dielectric constant materials 7-4 and 7-5 can be applied to a fraction of the overall area of the top and bottom sides of the PWB 7-1 as illustrated in FIG. 7*b* and cured. Partial reflector plates 7-9 and 7-10 can be placed on the foam or material during curing as indicated by 7-8 in FIG. 7*c*. These reflector plates, although shown as rectangles, can be of any polygon shape as defined earlier. The partial reflector plates can be made using copper plates or other metal plates. These plates do not intersect the ground plane of the PCB surface. The partial reflectors can be stamped from metal sheets by using an L-shape, U-shape, or any other form that can be manufactured. Different shapes of planar reflector plates can be stamped out that can be used to adjust antenna performance.

Figure 7F:
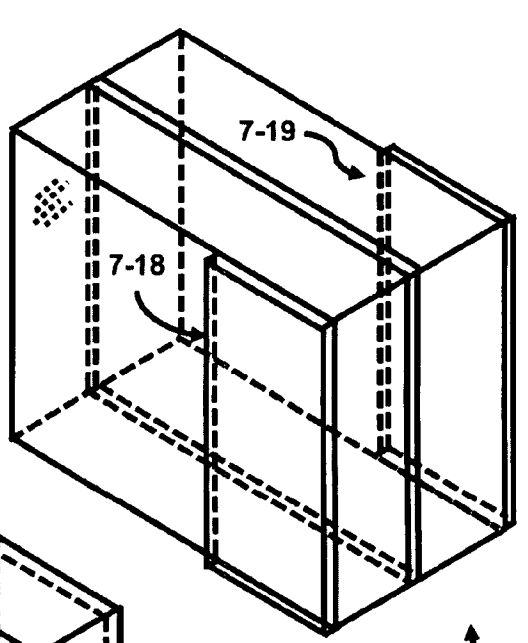
FIG. 7*f* illustrates the addition of the out-of-plane reflector plates to the outside of the foam in accordance with the present invention.
Figure 7E:
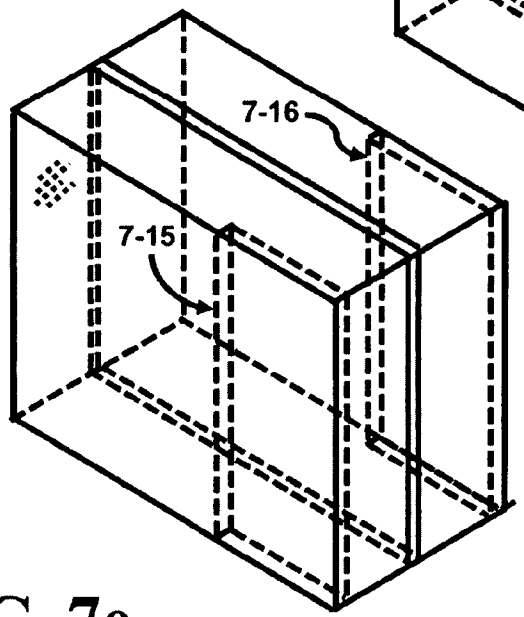
FIG. 7*e* illustrates the addition of the out-of-plane reflector plates inside the foam in accordance with the present invention.
Figure 7D:
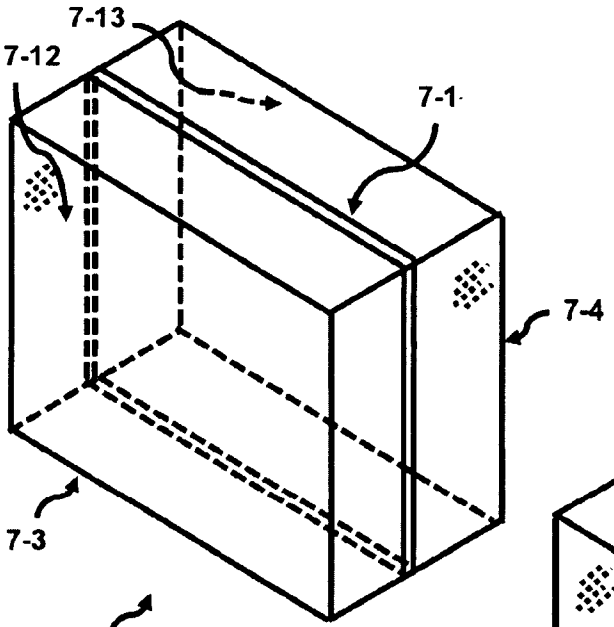
FIG. 7*d* depicts a PWB front and back surfaces covered with a foam that cures into a non-conductive low-dielectric constant material.

Foams that contain other non-conductive low-dielectric constant materials 7-4 and 7-5 can be applied to the entire top and bottom sides 7-12 and 7-13 of the PWB 7-1 forming the structure 7-11 as illustrated in FIG. 7*d* and cured. Partial reflector plates 7-15 and 7-16 can be placed in the foam or material during curing as indicated in the structure 7-14 in FIG. 7*e*. The partial reflector plates can be made using copper plates or other metal plates. These plates do not intersect the ground plane of the PCB surface. The partial reflectors can be stamped from metal sheets by using an L-shape, U-shape, or any other form that can be manufactured. Different shapes of planar reflector plates can be stamped out that can be used to adjust antenna performance.

Partial reflector plates 7-18 and 7-19 can be placed on the cured foam or material as indicated in the structure 7-17 in FIG. 7*f*. The partial reflector plates can be made using copper plates or other metal plates. These plates do not intersect the ground plane of the PCB surface. The partial reflectors can be stamped from metal sheets by using an L-shape, U-shape, or any other form that can be manufactured. Different shapes of planar reflector plates can be stamped out that can be used to adjust antenna performance.

Figure 8C:
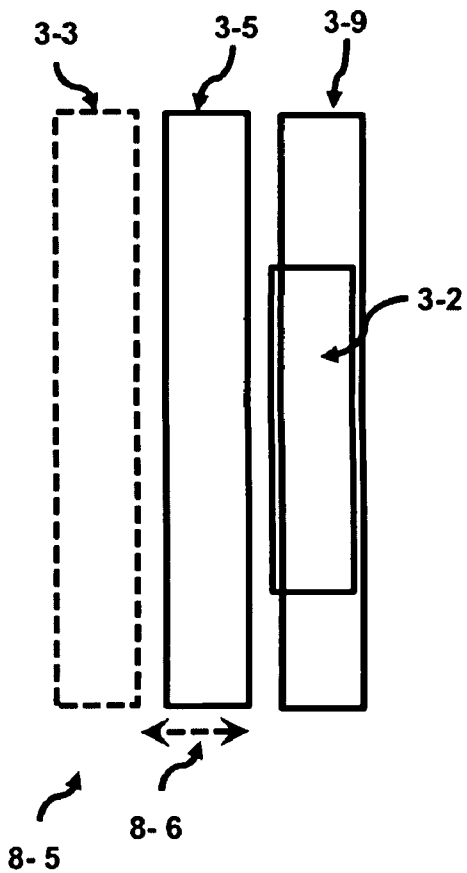
FIG. 8*c* illustrates a side view 8-5 of the staggering between two sets of reflector plates of FIG. 4*c* in accordance with the present invention.
Figure 8B:
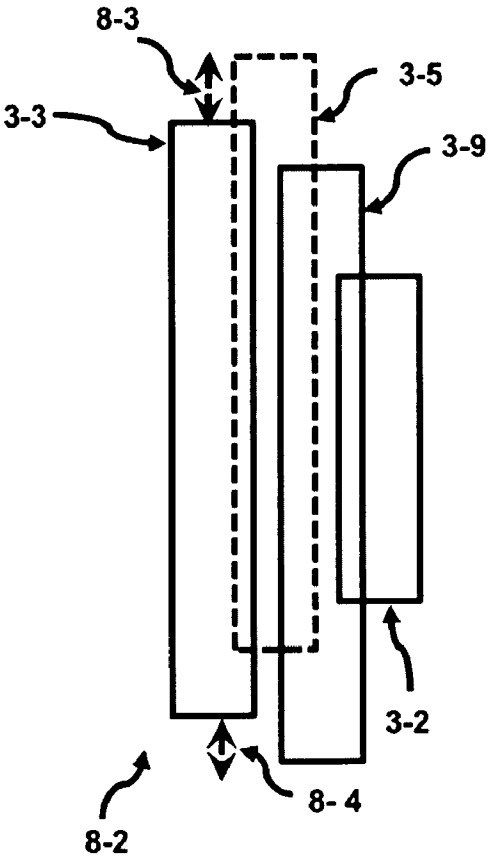
FIG. 8*b* shows a side view 8-2 of the offset between sets of reflector plates of FIG. 4*b* in accordance with the present invention.
Figure 8A:
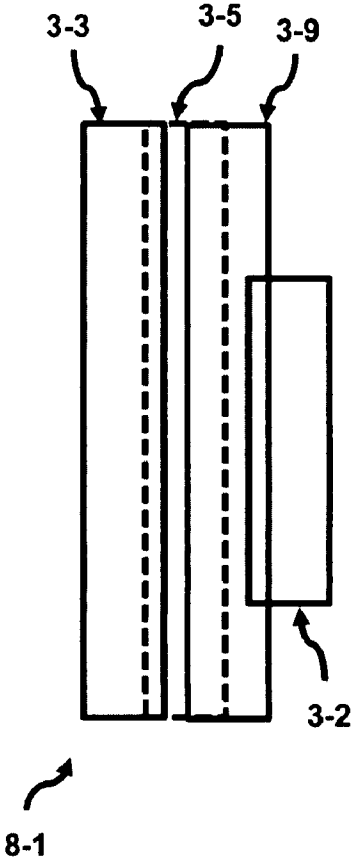
FIG. 8*a* depicts a side view 8-1 of the driver and reflector plates of FIG. 4*a* in accordance with the present invention.

FIG. 8*a* illustrates a view 8-1 in FIG. 4*a*. The numbers if used earlier correspond to the same item. The plate 3-2 is the driver plate while plate 3-3 can be located in the ground plane of the PWB. The plate 3-5 is in front of the plate 3-4 (being hidden) while the plate 3-9 is in front of plate 3-10 (also being hidden). The plates 3-5 and 3-4 together form the first set of reflector plates. Plate 3-5 is in front of the ground plane of the PWB just as much as the plate 3-4 (not shown) is behind the ground plane of the PWB. In addition, the shape of both of these plates 3-5 and 3-4 are mirror images of one another. The additional set of reflector plates is formed by reflector plates 3-9 and 3-10.

FIG. 8*b* shows a view 8-2 where offsets have been applied to the first and additional sets of reflector plates. The offset of the first set of reflector plates 3-5 and 3-4 is indicated as the offset distance 8-3. The additional set of reflector plates 3-9 and 3-10 are offset in the negative direction 8-4. The offset can be measured with respect to a point on the ground plane of the PWB.

FIG. 8*c* illustrates a view 8-5 where staggering have been applied to the first and additional sets of reflector plates. The staggering of the first set of reflector plates 3-5 and 3-4 is indicated as the stagger distance 8-6. The additional set of reflector plates 3-9 and 3-10 are staggered in the by the same stagger distance 8-6. The stagger distance is measured with respect to one of the corners of the ground plane of the PWB.

The mechanism of introducing offset or staggering between multiple reflectors along the main beam direction to further improve gain. The mechanism of varying spacing and offset of multiple reflectors also adjusts and steers the beam direction and the angular coverage. In addition, the out-of-plane metal plates can be used to focus the elevation of the beam. The physical dimensions and positions of the plates in the antenna can be designed to adjust one or more parameters of the antenna. Some of these parameters that can be adjusted include the gain, the beam direction or the angular coverage. The proper selection of the dimensions and positions of the plates can be used to achieve optimum performance. The reflector is longer than the driver antenna, this helps collect some EM energy scattered into the direction of the top and bottom edge of the reflector and re-focus it back to the main beam direction; secondly, metal reflectors can be placed on the top and bottom of the driver antenna to further reflect energy back to the main beam.

Figure 9B:
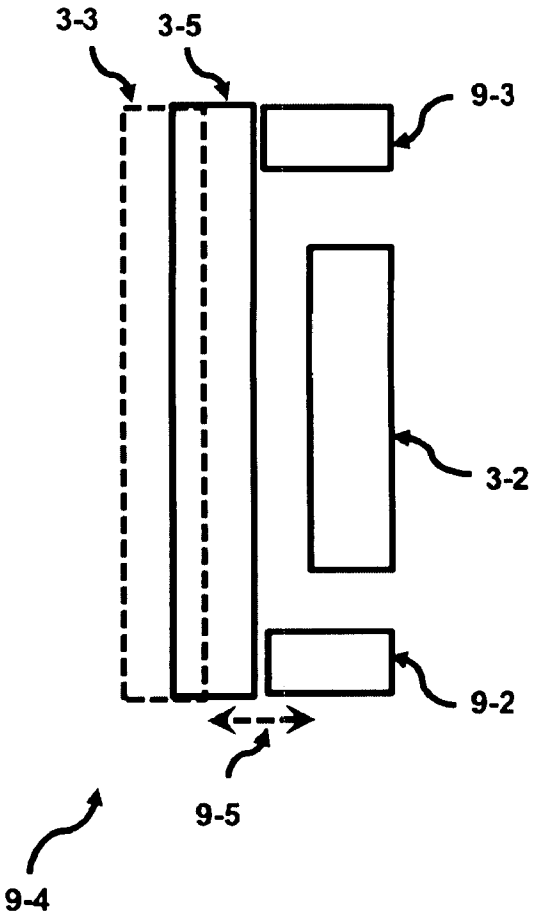
FIG. 9*b* depicts a side view of the driver, reflector, top and bottom plates of FIG. 9*a* in accordance with the present invention.
Figure 9A:
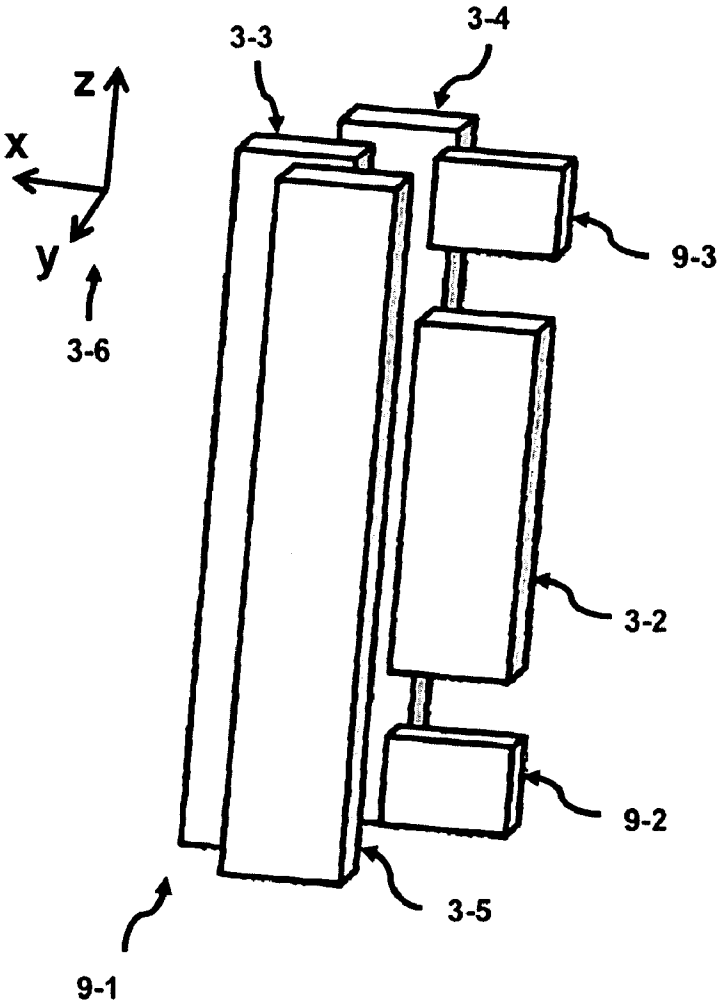
FIG. 9*a* presents a top view perspective of a high gain multiple planar reflector antenna structure with an in-plane top and bottom plate in accordance with the present invention.

FIG. 9*a* illustrates a side perspective for one embodiment of an antenna 9-1 that uses reflectors both in and out-of-plane. A Cartesian coordinate axis 3-6 is provided. The transceiver (not shown) would be coupled to a driver plate 3-2. The remaining elements are an in-plane reflector plate 3-3 and the two additional top and bottom reflector plates 9-2 and 9-3. These four elements are in the xz plane with y=0. A first out-of-plane reflector plate 3-4 is located in the negative y region or below the xz plane. The second out-of-plane reflector plate 3-5 is located in the positive y region or above the xz plane. The in-plane reflector plate 3-3, the driver plate 3-2, the two reflector plates 9-2 and 9-3 are all isolated from each other; that is, the electrical impedance between all four conductor plates are Mega Ω's or higher. This isolation can occur when the metal layer used to form the reflector and driver plates is partitioned into at least four separate metallic segments isolated by the dielectric forming the PWB.

FIG. 9*b* illustrates a view 9-4 in FIG. 9*b*. The numbers if used earlier correspond to the same item. The plate 3-2 is the driver plate while plates 3-3, 9-2 and 9-3 can be located in the ground plane or in segmented metal areas of a metal layer in the PWB. The plate 3-5 is in front of the plate 3-4 (being hidden) while the plate 3-9 is in front of plate 3-10 (also being hidden). The plates 3-5 and 3-4 together form the first set of reflector plates. The plates 9-2 and 9-3 form a top and bottom reflectors. Plate 3-5 is in front of the ground plane of the PWB just as much as the plate 3-4 (not shown) is behind the ground plane of the PWB. In addition, the shape of both of these plates 3-5 and 3-4 are mirror images of one another.

Finally, it is understood that the above description are only illustrative of the principle of the current invention. It is understood that the various embodiments of the invention, although different, are not mutually exclusive. In accordance with these principles, those skilled in the art may devise numerous modifications without departing from the spirit and scope of the invention. For example, the techniques of the invention can be practiced in the wireless arena which can include the security, entertainment, business, and gaming industries. It can also be practiced in different wireless standards such as WiMedia MB-OFDM; 802.11a/b/g/n; 802.16 WiMAX; 802.15 WPAN, etc.

What is claimed is:

1. A multi planar antenna comprising:

a metallic driver plate patterned in a metal layer of a PWB;

a first reflector plate patterned in the metal layer of the PWB and isolated from the driver plate;

at least one set of reflector plates comprising:

an upper reflector plate placed above the metallic driver plate; and a lower reflector plate placed below the metallic driver plate; wherein the driver and all reflector plates can assume any polygon shape, and all plates are isolated from one another, and wherein the upper and lower reflector plates are staggered along a main beam direction.

2. The apparatus of claim 1, wherein the first reflector plate comprises a portion of a PCB board ground.

3. The apparatus of claim 1, wherein the plates are substantially parallel to one another.

4. The apparatus of claim 1, wherein each set of reflector plates can be offset in a perpendicular direction from the main beam direction.

5. The apparatus of claim 1, further comprising:

a non-conductive low-dielectric constant material deposited on both opposing planar surfaces of the PWB; wherein the upper and lower reflector plates are placed on the opposing planar surfaces of the material.

6. The apparatus of claim 1, further comprising:

a product housing unit supporting the PWB;

the PWB is placed between opposing sidewalls of the product housing unit; wherein the upper and lower reflector plates are attached to the opposing sidewalls.

7. The apparatus of claim 1, further comprising:

a transceiver coupled to the driver plate that allows a communication protocol to be used, wherein the communication protocol is Ultrawide-band (UWB) wireless, WiMedia, MB-OFDM, 802.11a/b/g/n, 802.16, WiMAX, 802.15 or WPAN.

8. The method of improving the gain of an antenna by using multiple planar reflectors comprising the steps of:

pattering a metallic driver plate in a metal layer of a PWB;

pattering a first reflector plate in the metal layer of the PWB;

isolating the driver plate from the first reflector plate;

positioning at least one set of reflector plates where the set comprises an upper reflector plate placed above the metallic driver plate, and a lower reflector plate placed below the metallic driver plate, and wherein the upper and lower reflector plates are staggered along a main beam direction; and wherein the driver and all reflector plates can assume any polygon shape, and all plates are isolated from one another.

9. The method of claim 8, wherein the first reflector plate comprises a portion of a PCB board ground.

10. The method of claim 8, wherein the plates are substantially parallel to one another.

11. The method of claim 8, further comprising:

depositing a layer of non-conductive low-dielectric constant material on the top and bottom planar surfaces of the PWB; wherein the upper and lower reflector plates are placed on the opposing planar surfaces of the material.

12. The method of claim 8, further comprising:

supporting the PWB within a product housing unit;

attaching the upper and lower reflector plates to the opposing sidewalls; and positioning the PWB between the upper and lower reflector plates.

13. The method of claim 8, further comprising:

staggering the placement of the sets of reflector plates along a main beam direction.

14. The method of claim 8, further comprising:

offsetting the placement of the sets of reflector plates from the main beam direction.

15. A method of adjusting a parameter of a multi planar antenna comprising the steps of:

patterning a driver plate in a first metal layer of a PWB;

patterning a first reflecting plate in another portion of the first metal layer of the PWB;

a means for forming a plurality of sets of reflector plates; and a means for positioning these sets of reflector plates with respect to a main beam direction to adjust a parameter of the antenna, wherein a set of upper and lower reflector plates are offset along the main beam direction.

16. The method of claim 15, wherein the parameter is gain, the beam direction or the angular coverage.

* * * * *